US007832590B2

(12) United States Patent
Smith et al.

(10) Patent No.: US 7,832,590 B2
(45) Date of Patent: Nov. 16, 2010

(54) INSERTS FOR MULTIPLE COMPONENT CONTAINERS

(75) Inventors: Matthew Eric Smith, Ballaugh (GB); Karl Mondszein, Nottinghamshiire (GB)

(73) Assignee: Carbonite Corporation, Panama City (PA)

( * ) Notice: Subject to any disclaimer, the term of this patent is extended or adjusted under 35 U.S.C. 154(b) by 657 days.

(21) Appl. No.: 11/791,778

(22) PCT Filed: Oct. 25, 2006

(86) PCT No.: PCT/GB2005/003991

§ 371 (c)(1),
(2), (4) Date: May 29, 2007

(87) PCT Pub. No.: WO2006/043038

PCT Pub. Date: Apr. 27, 2006

(65) Prior Publication Data

US 2007/0295740 A1 Dec. 27, 2007

(30) Foreign Application Priority Data

Oct. 19, 2004 (GB) ..... 0423237.7

(51) Int. Cl.
*B65D 6/12* (2006.01)
*B65D 51/18* (2006.01)
*B65D 51/24* (2006.01)

(52) U.S. Cl. ..... 220/721; 220/259.5; 220/203.13; 220/203.24; 220/360; 220/501; 220/528

(58) Field of Classification Search ..... 220/254.1, 220/501, 502, 522, 203.14, 721, 723, 720, 220/259.5, 528, 203.13, 203.24, 360, 203.28
See application file for complete search history.

(56) References Cited

U.S. PATENT DOCUMENTS 2,753,990 A 7/1956 Chalfin et al.

(Continued)

FOREIGN PATENT DOCUMENTS

EP 0686573 12/1995

(Continued)

OTHER PUBLICATIONS

PCT Notification of Transmittal Of International Preliminary Report on Patentability dated May 21, 2008 (7 pages).

*Primary Examiner*—Anthony Stashick
*Assistant Examiner*—Niki M Eloshway
(74) *Attorney, Agent, or Firm*—Cowan, Liebowitz & Latman

(57) ABSTRACT

An insert for a multiple component container includes a reservoir with an opening defined by a peripheral edge which, in use, is connected to a sealing element (20). In use, the reservoir and the sealing element define a substantially sealed space. The reservoir includes a stationary portion (2) and a movable portion (4), which is connected to the stationary portion and is movable with respect thereto by the action of gas pressure within the reservoir. A discharge opening (6) is formed in the movable portion (4) and a gas leakage path is provided in the reservoir wall. A valve member (14) is connected to the stationary portion (2) and cooperates with the discharge opening (6) and substantially seals it. The application of a greater gas pressure to the interior of the reservoir than to its exterior results in movement of the movable portion (4) away from the stationary portion (2) and thus in the valve member (14) moving out of sealing contact with the discharge opening (6).

9 Claims, 4 Drawing Sheets

U.S. PATENT DOCUMENTS

| | | | | | |
|---|---|---|---|---|---|
| 2,764,983 | A | | 10/1956 | Pius et al. | |
| 3,193,154 | A | | 7/1965 | Helmut | |
| 3,337,039 | A | | 8/1967 | Knittel et al. | |
| 3,743,520 | A | | 7/1973 | Croner | |
| 3,821,876 | A | * | 7/1974 | Glaspell | 55/385.1 |
| 4,264,007 | A | * | 4/1981 | Hunt | 206/219 |
| 4,524,078 | A | * | 6/1985 | Bardsley et al. | 426/112 |
| 4,634,003 | A | | 1/1987 | Ueda et al. | |
| 5,560,513 | A | * | 10/1996 | Jarrell | 220/705 |
| 5,571,548 | A | * | 11/1996 | Lynch et al. | 426/112 |
| 5,620,725 | A | * | 4/1997 | Jamieson et al. | 426/112 |
| 5,950,819 | A | * | 9/1999 | Sellars | 206/221 |
| 6,076,558 | A | * | 6/2000 | Mohr et al. | 303/115.4 |
| 6,390,292 | B2 | | 5/2002 | Hawthorne | |
| 6,935,493 | B2 | | 8/2005 | Cho | |
| 6,951,275 | B2 | | 10/2005 | Serra Galdos | |
| 6,976,578 | B1 | * | 12/2005 | Kenihan | 206/222 |
| 7,017,735 | B2 | * | 3/2006 | Carlson | 206/222 |
| 2007/0164039 | A1 | * | 7/2007 | Vanblaere et al. | 220/723 |

FOREIGN PATENT DOCUMENTS

| | | |
|---|---|---|
| GB | 2303363 | 2/1997 |
| WO | 95/04689 | 2/1995 |
| WO | 95/30603 | 11/1995 |
| WO | 96/38351 | 12/1996 |
| WO | 03/039992 | 5/2003 |

* cited by examiner

INSERTS FOR MULTIPLE COMPONENT CONTAINERS

CROSS-REFERENCES TO RELATED APPLICATIONS

This application claims priority to International Application No. PCT/GB2006/003991 filed Oct. 25, 2006, which claims priority to Great Britain Application No. 0601018.5 filed Jan. 18, 2006. This application is also a continuation-in-part of U.S. patent Ser. No. 11/456,929 filed Jul. 12, 2006, the entire disclosure of which is hereby incorporated by reference.

The present invention relates to inserts for multiple component containers, which contain two or more different substances or components which are stored separately but are mixed together at the time the container is opened.

There are many fields in which multiple component, particularly binary component, containers are used or are desirable. Thus, there are certain pharmaceutical compositions which are administered in the form of a mixture but which are unstable in the long term in the form of a mixture. The components of such a composition are therefore stored separately and only mixed shortly before administration. In this case, both components are generally in liquid form but it is also possible for one of the components to be in solid or powder form. Such containers may also find application in the foodstuff market, particularly for beverages. Thus it is desirable, for instance in connection with canned or bottled lager and lime, only to mix the lime into the lager shortly before consumption of the beverage.

It is the object of the invention to provide an insert for a multiple component container which is simple and cheap and which enables one component in the container to be reliably automatically mixed with a second component in the container as the container is opened.

According to the present invention, an insert for a multiple component container includes a reservoir with an opening defined by a peripheral edge for engagement with a sealing element, the reservoir, in use, together with a sealing element, defining a substantially sealed space, the reservoir including a stationary portion and a movable portion, the movable portion being connected to the stationary portion and being movable with respect thereto by the action of gas pressure within the reservoir, a discharge opening being formed in the movable portion, a gas leakage path being provided in the reservoir, a valve member connected to the stationary portion and cooperating with the discharge opening and substantially sealing it, whereby the application of a greater gas pressure to the interior of the reservoir than to its exterior results in movement of the movable portion relative to the stationary portion and thus in the valve member moving out of sealing contact with the discharge opening.

In use, the opening will be sealed by a sealing element and the insert will be partially filled with one component, preferably in liquid form, of a multiple component system and will be placed inside a container including a further component of the multiple component system. Once the container has been sealed by means of a lid or other closure, which may be separate from the insert or may be connected to it, the interior of the container, that is to say the head space above the component situated within it, is pressurised. If the component with the container is a carbonated beverage, this pressurisation will occur automatically by virtue of the progressive release of carbon dioxide from it. If, however, the component within the container is not carbonated and is e.g. a pharmaceutical preparation, this pressurisation of the head space of the container may be conveniently effected by adding a few drops of e.g. liquid nitrogen into the container immediately before it is sealed. Vaporisation of the nitrogen will commence immediately and the initial vaporisation will result in the atmospheric air in the head space being replaced by the nitrogen. Subsequent vaporisation of the nitrogen after application of the sealing lid will result in pressurisation of the head space. The gas leakage path in the reservoir will progressively admit pressurised gas into its interior, whereby the pressure within the reservoir will reach a value substantially the same as that in the pressurised head space of the container. When the container lid is removed, the head space of the container will be instantly depressurised. However, the leakage path in the diaphragm is sufficiently small that instant depressurisation of the interior of the reservoir is not possible, whereby a substantial pressure differential across the reservoir will be created. This will act on the movable portion of the reservoir and will result in relative movement of the movable portion of the reservoir with respect to, that is to say away from, the stationary portion. This movement of the movable portion away from the stationary portion inherently produces movement of the discharge opening away from the valve member. This movement is sufficient to move the discharge opening out of cooperation with the valve member, whereby the discharge opening is now open. The gas pressure prevailing within the reservoir will then expel the component within the reservoir through the discharge opening and into the body of the container, where it will mix with the other components present therein. The container now contains a two-component mixture which may then be administered to a patient or otherwise used.

The movable portion of the reservoir may take many forms and in one embodiment of the invention comprises a resilient, e.g. elastomeric, membrane, which is attached to the remainder of the reservoir and in which the gas discharge opening is formed. When a greater pressure prevails within the reservoir, the membrane will distend in the manner of a balloon and this will result in movement of the discharge opening away from the stationary portion of the reservoir and thus in the valve member ceasing to block the discharge opening. This will, however, necessitate the two portions of the reservoir being made of different materials.

In a preferred embodiment, the reservoir is a one-piece plastic moulding comprising a diaphragm and the movable portion is connected to the stationary portion by at least two annular fold lines of opposite sense, whereby the application of a greater gas pressure to the interior of the reservoir than to its exterior results in rotational movement about the fold lines and thus in movement of the movable portion. When a pressure differential acts across the reservoir wall of this embodiment, this will produce relative rotation of the annular portions of the reservoir on each side of each fold line, which effectively constitutes an integral hinge, and this rotation will result in movement of the movable portion and thus also of the discharge opening away from the stationary portion.

In a further preferred embodiment, the stationary and movable portions are slidably connected together in the manner of a piston and cylinder, that is to say telescopically. When a pressure differential acts across the reservoir wall, the movable portion slides with respect to the stationary portion in a direction away from the stationary portion, which again results in the valve member moving out of cooperation with the discharge opening.

The valve member may take various forms but in a simple preferred embodiment, it constitutes a spigot or the like which is integrally connected to the peripheral edge. This spigot will normally cooperate with the discharge opening, e.g. extend into it and form a seal with it, so as to close the discharge opening and prevent premature discharge of the component within the reservoir into the container. It is convenient for manufacturing reasons for the valve member to be integral with the peripheral edge of the stationary portion of the reservoir and this will necessitate the spigot being connected to the reservoir by means of a link or connector of some sort. This link will inherently be relatively long and in order to ensure that it is retained in the desired position, it is preferred that the insert includes a support member integral with the stationary portion which is engaged by the link and stabilises it.

The gas leakage path in the diaphragm may be constituted simply by a very small hole in it. It is, however, convenient if the valve member and discharge opening together define the gas leakage path because this will obviate the necessity of forming a separate leakage path. It is preferred that the valve member and discharge opening together constitute a one-way valve defining the gas leakage path through which gas may flow into the reservoir but not out of it.

The insert may be used with two-component containers and in this event one component will of course be stored in the body of the container and the other in the insert. The invention is, however, applicable to containers for three or more component systems and thus the reservoir may include one or more partitions dividing it into two or more compartments, each of which communicates with a respective flow opening cooperating with a respective valve member. In use, each compartment will of course be filled with a different component of the multi-component system. In the first of the two preferred embodiments referred to above, it is preferred that each flow opening is associated with a respective set of at least two spaced annular fold lines.

The insert may be supplied to a bottle manufacturer or the like in an unsealed condition, that is to say without the opening being sealed by a sealing element. The insert will of course need to be sealed prior to use to prevent leakage or contamination of its contents and the sealing element may be a sheet of plastic material or of metal or a composite thereof sealingly connected to the peripheral edge of the diaphragm. The invention therefore embraces an insert both with and without a sealing element.

The insert may be applied to a container in the form of a discrete component and the lid or other closure subsequently applied to the container. It is, however, convenient if the insert and closure constitute a composite unit, whereby they are then applied simultaneously to the container. Such a closure will include a closure plate which, in use, extends across a dispensing opening in the container and it is therefore possible for the sealing sheet of plastic material or the like to be omitted and for the closure plate of the closure to constitute the sealing element of the insert.

Further features and details of the invention will be apparent from the following description of certain specific embodiments which is given by way of example only with reference to the accompanying drawings, in which.

Figure 1:
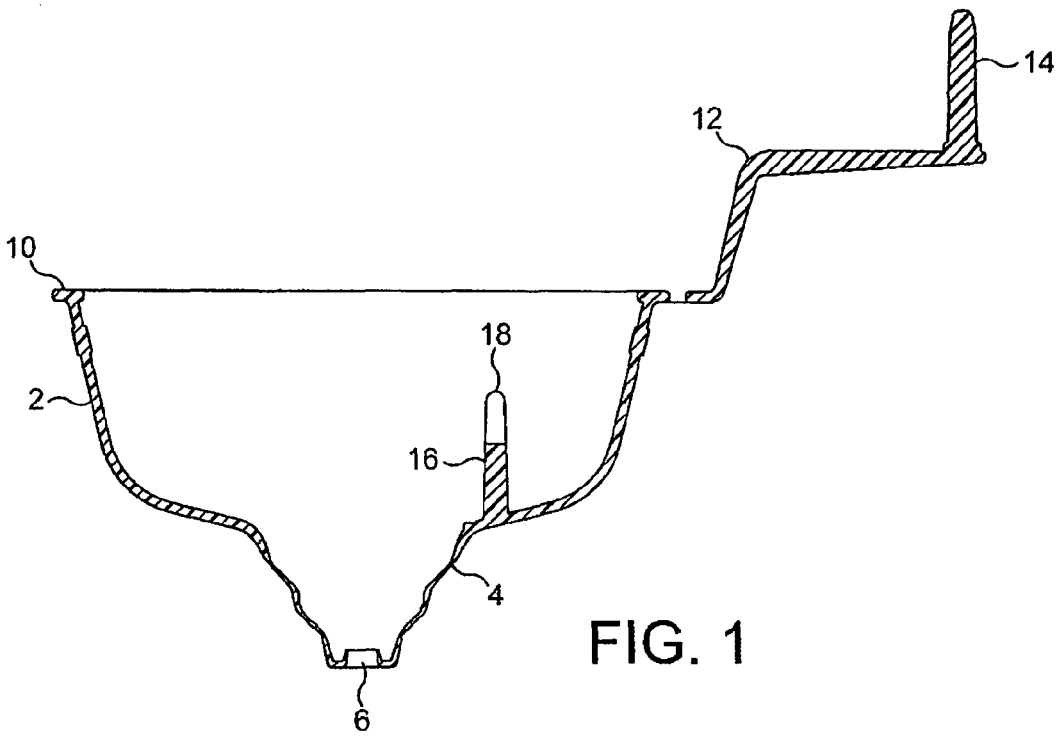
FIG. 1 is an axial sectional view of a first embodiment of an insert in accordance with the present invention in the "as-moulded" state.
Figure 2:
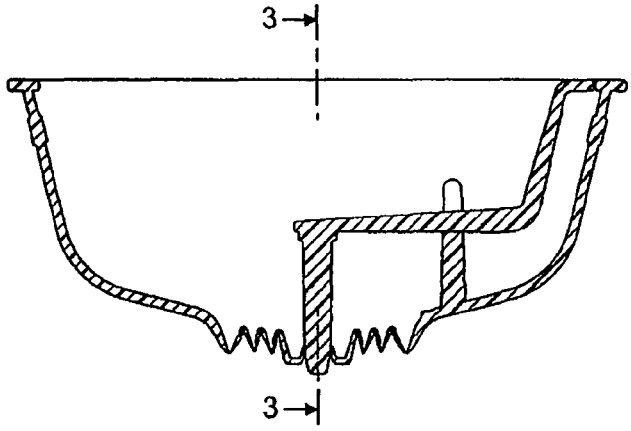
FIG. 2 is an axial sectional view of the insert of FIG. 1 in the operative configuration.
Figure 3:
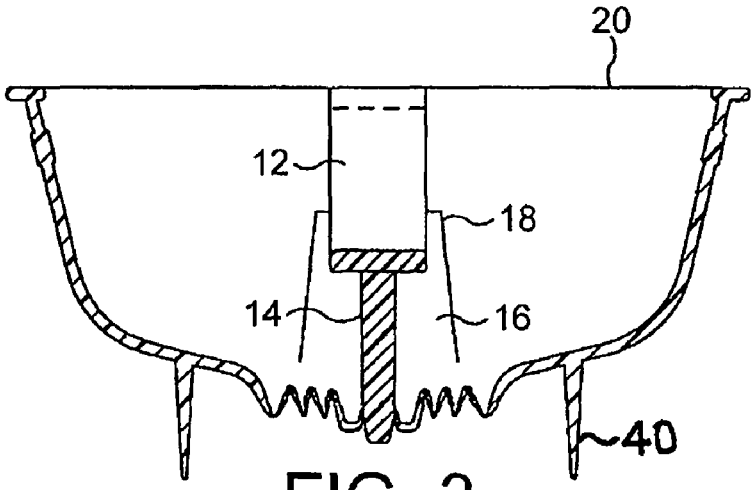
FIG. 3 is an axial sectional view on the line 3-3 in FIG. 2 which additionally shows an optional modification.
Figure 4:
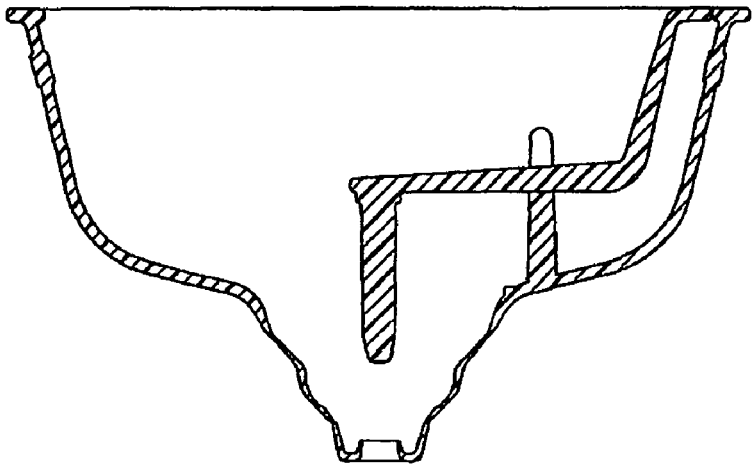
FIG. 4 is a view similar to FIGS. 1 and 2 showing the insert after its contents have been expelled into a container.
Figure 5:
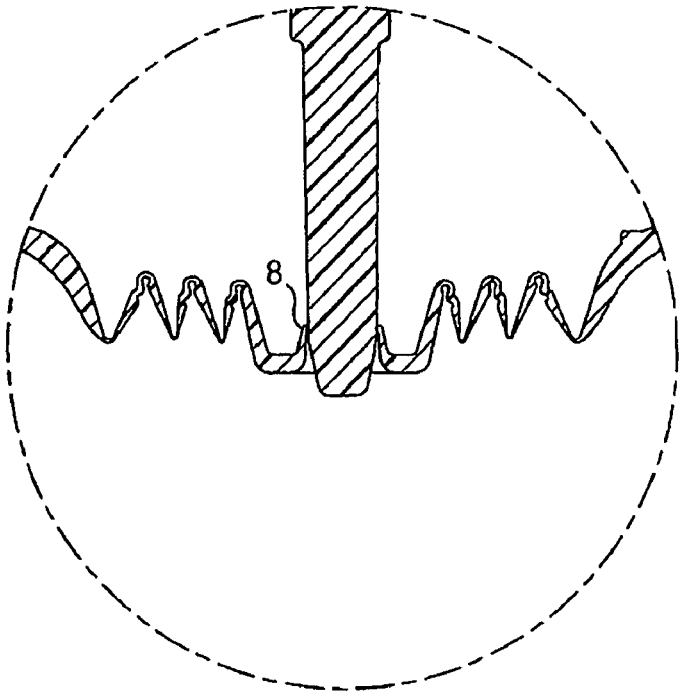
FIG. 5 is a scrap view on an enlarged scale showing the valve spigot located in the flow opening.

The insert illustrated in FIGS. 1 to 5 constitutes a one-piece moulding of polypropylene or the like. It could, however, also be made from metallic foil or from a composite comprising metal and plastics material which is stamped or pressed into shape. When the insert is ejected from the mould, it has the configuration shown in FIG. 1. It comprises an open-topped, generally cup-shaped member 2, formed in whose base is a depending pocket 4. The downwardly and inwardly inclined annular wall of the pocket 4 is formed with a plurality of spaced, annular lines of weakness, that is to say lines of reduced thickness, whose function will be described below. Formed in the base of the pocket 4 is a flow opening 6, which is defined by a flexible marginal lip 8, seen in FIG. 5. Moulded integrally with the upper peripheral edge of the insert is a peripheral flange 10, moulded integrally with which is one end of an elongate connector link 12, which extends generally laterally. Integral with the free end of the link 12 is a spigot 14, which extends vertically upwardly in the as-moulded state. Moulded integrally with the base of the cup-shaped member 2, radially outside the pocket 4, is an upstanding support 16. The support 16 comprises an upstanding web, at the two ends of whose upper surface there are respective upstanding lugs 18, the space between which is substantially equal to the width of the link 12. The support 16 thus affords a generally rectangular recess at its upper end defined by the inner edges of the two lugs 18. This support may, however, not be necessary and may thus be omitted.

The insert is now brought into the operative configuration by applying an upward force to the lower end of the pocket 6. This results in the annular wall of the pocket 4 corrugating, that is to say folding about the annular lines of weakness, adjacent folds being of opposite sense. The pocket 4 is moved upwardly until it is generally at the same level as the remainder of the base of the cup-shaped portion 2. Prior or subsequent to this, the link 12 is rotated through 180° in the anticlockwise direction, as seen in FIG. 1, until it reaches the position shown in FIG. 2. The free end, which is of frusto-conical shape in this case, of the spigot is inserted into the opening 6 defined by the upwardly extending lip 8. The internal diameter of the lip 8 and the external diameter of the spigot 14 are so matched to one another that the spigot 14 expands the lip 8 outwardly, whereby the lip 8 is urged into contact with the surface of the spigot 14 and thus forms a substantial gas seal with it. When in this position, the link 12 is supported on the upper surface of the support 16 and restrained from lateral movement by the lugs 18.

The insert is then partially filled with the desired substance, in liquid or powder form, and in the present case it will be assumed that this substance is one component of a two-component pharmaceutical composition which is administered in the form of a mixture but is unstable in the long term in the form of a mixture. The insert is then sealed by connecting to the upper surface of its upper peripheral flange 10 a sealing film 20, preferably of metallised plastic material because such composite materials are impermeable to both liquids and vapours. The insert is now ready for use.

Before the insert is placed within a container, there is a risk that an impact or other force may inadvertently be applied to the exposed end of the spigot and this could result in leakage or even complete loss of the contents of the insert. In order to minimise the risk of this occurring, a minor modification may be effected, as shown only in FIG. 3. This consists of providing the exterior of the insert with an integral, depending annular flange 40, which extends around the exposed end of the spigot 14 and extends down to a point below the end of the spigot. This flange, which could be replaced by a number of discrete projections, will protect the end of the spigot from impacts.

The insert may be used in a variety of ways but in its simplest form it is placed within the neck of a binary component container, which already contains the other component of the two-component pharmaceutical composition referred to above, with its peripheral flange 10 resting on the rim of the container. Before positioning the insert on the rim of the container, a few drops of liquid nitrogen are inserted into the container and an outer sealing lid is then rapidly applied before all the nitrogen has vaporised. The initial vaporisation of the liquid nitrogen will fill the head space of the container with nitrogen and displace all atmospheric air and any bacteria contained therein. The subsequent vaporisation of the nitrogen, which occurs after application of the lid, will increase the pressure in the head space of the container to a superatmospheric level. As this pressure increases, the lip 8 will yield outwardly to open up a small gas leakage path into the interior of the insert. The pressure in the interior of the insert will therefore over time reach a value substantially equal to that in the head space of the container.

When it is desired to administer the two-component pharmaceutical composition, the container lid is removed. This will result in instant depressurisation of the head space of the container. However, the valve constituted by the engagement of the lip 8 with the spigot 14 is a one-way valve, by virtue of the orientation of the lip 8. The interior of the insert is thus not instantly depressurised and there is therefore a substantial pressure differential across the wall of the pocket 4. This results in instantaneous movement of the pocket downwardly accompanied by simultaneous unfolding of the various folds in its annular wall, this unfolding being in opposite senses in adjacent folds. As the lower portion of the pocket moves downwardly, the rim 8 of the flow opening 6 will move out of contact with the spigot 14, which is stationary. The flow opening 6 is now unobstructed and the superatmospheric pressure prevailing in the interior of the insert above the pharmaceutical component within it now acts to expel the pharmaceutical component rapidly through the opening 6 into the container, where it will mix with the pharmaceutical component already in the container with the aid of the mixing action produced by the high speed jet through the opening 6. The pocket may be so dimensioned and the container may be filled to such a level that the opening 6 is situated below the level of the liquid in the container, though this is not essential. The insert will now be in the configuration shown in FIG. 4 and may be discarded. The two-component pharmaceutical composition may now be administered to the patient.

Figure 6:
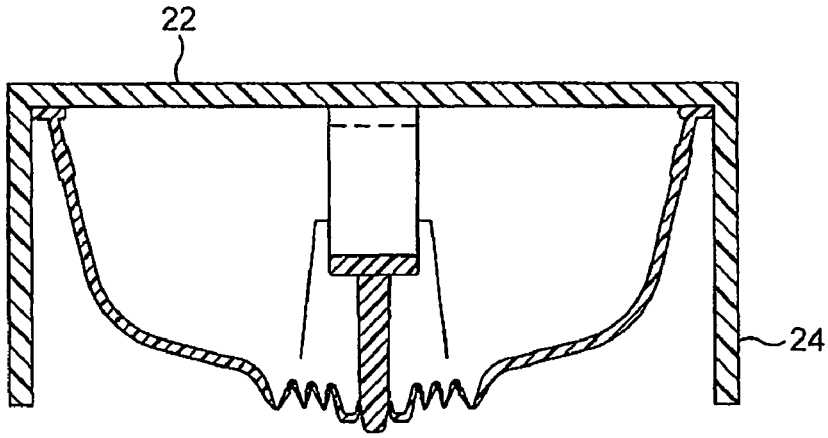
FIG. 6 is a view similar to FIG. 3 showing a container cap incorporating an insert in accordance with the invention.

As described above, the insert in accordance with the invention and the closure or lid are applied to the container separately. It may, however, be more convenient to integrate the insert with the lid and such a construction is shown in FIG. 6. Such an integrated construction may comprise an insert as illustrated in FIGS. 1 to 5 secured within the lid, e.g. by virtue of a push-fit or by adhesive or the like. However, this lid will necessarily have a cover plate, designated 22 in FIG. 6, which will extend over the opening in the container and possibly also a depending peripheral skirt 24, bearing a screw thread or the like (not shown) if the container is of conventional type with a dispensing opening formed in a neck. The presence of the closure plate 22 opens up the possibility of omitting the sealing film 20, the function of which is then fulfilled by the cover plate 22, which is sealed by any appropriate means to the upper flange 10 of the insert.

It will be appreciated that the insert and lid described above are for use with a binary component container, that is to say a container which contains one component in the body of the container and a second component to be mixed with it in the insert. However, the insert and lid in accordance with the invention can also be used for containers to contain three or more different components to be mixed shortly before use or administration. Thus in a modified embodiment, which is not illustrated, the insert is for use with a container to contain three different components. The base of the cup-shaped member 2 is formed with two sets of annular, preferably concentric, fold lines of opposite sets, a respective discharge opening being situated within each set of fold lines. The interior of the reservoir defined by the insert is divided into two compartments by a partition which is integral with the wall and base of the insert and extends between the two sets of fold lines, whereby each of the compartments communicates with a respective flow opening. Also integrally formed with the cup-shaped member are two spigots and links, substantially the same as that illustrated in FIGS. 1 to 6, cooperating with respective flow openings. It will be appreciate that, in use, the two compartments will be filled with different components and that operation of the insert is essentially the same as that described above, the only difference being that when the container is opened both flow openings will move downwardly and thus move out of contact with the associated spigots, whereby the two flow openings will be opened substantially simultaneously and the contents of the two compartments will be expelled into the body of the container substantially simultaneously and will be mixed with the third component already present in the body of the container.

Figure 7:
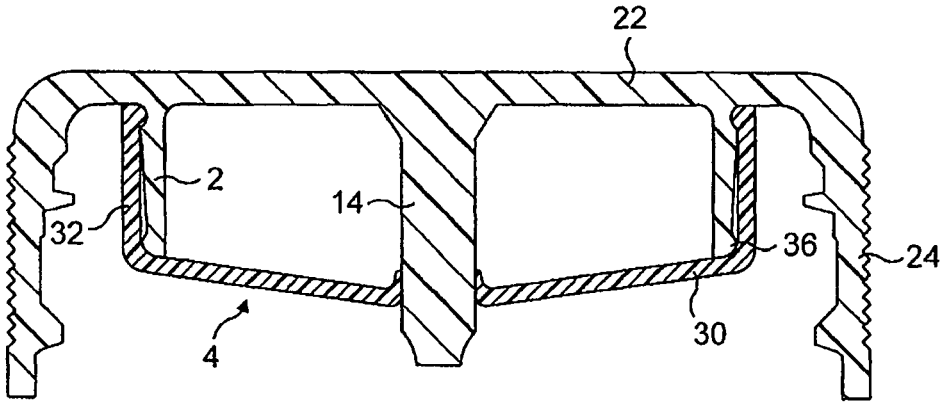
FIGS. 7 and 8 are axial sectional views of a further embodiment of container cap in accordance with the invention in the operative condition and after its contents have been expelled, respectively.
Figure 8:
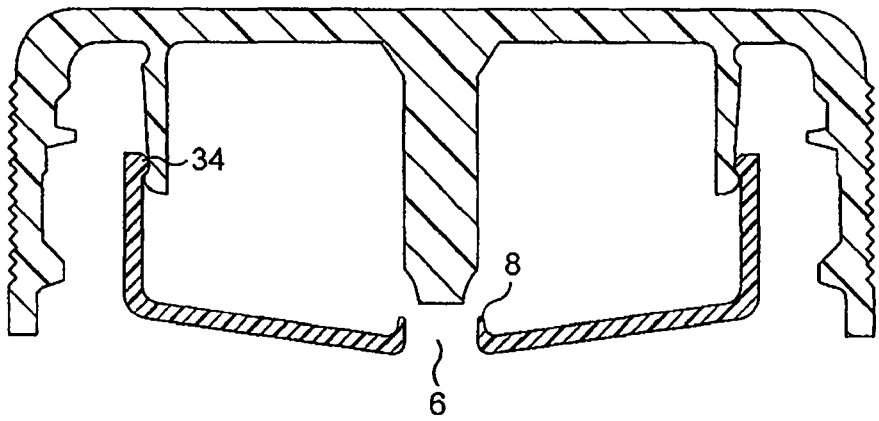

FIGS. 7 and 8 show an alternative embodiment in which the movability of the movable portion is achieved by a totally different mechanism. The fixed portion 2 of the reservoir comprises a short tube or annular flange which is integrally moulded with the closure plate 22 of a closure cap. The movable portion 4 of the reservoir is of generally cup shape comprising a bottom portion 30, in which the flow opening is formed, and an integral upstanding side wall 32 which is a sliding fit around the flange 2. The upper inner edge of the side wall 32 carries a protuberance 34 and the lower inner edge of the flange 2 carries a similar protuberance 36. Operation of this embodiment is generally similar to that of the preceding embodiment except that, when the container is opened, the pressure differential across the reservoir results in the movable portion 4 sliding downwardly on the flange 2 until the spigot 14 moves out of the opening 6, as shown in FIG. 8, and the contents of the reservoir are expelled into the container by the pressure within the reservoir. The protuberances 34 and 36 cooperate to ensure that the movable portion 4 is retained captive on the container lid.

Although this second embodiment is in the form of a closure or lid, it will be appreciated that the spigot 14 could be supported by an arm or link similar to the link 12 in the first embodiment and in this event the embodiment would constitute an insert rather than a closure. It will also be appreciated that this embodiment could also be readily adapted to inject two or more additional components into a container by providing two or more flow openings 6, which are separated from one another by partitions and cooperate with respective spigots.

The invention claimed is:

1. An insert adapted to be mounted in a multi-component container to hold one of the components of the container, comprising:

a one piece body having a reservoir and a valve member, said reservoir having a stationary segment and an expandable segment, said expandable segment having a plurality of annular fold lines of opposite sense, rotation about said fold lines providing a contracted state and an expanded state, said expandable segment having a discharge passage, said valve member engageable with said discharge passage when said expandable segment is in its contracted state, thus providing a closed state for said discharge passage, said valve member and said discharge passage in said closed state providing a one way gas leakage path into said reservoir, said valve member and said discharge passage disengaging when said expandable segment moves into its expanded state, thus providing an open state for said discharge passage, whereby assembly of said insert containing one of the components and in said closed state into a container permits leakage of gas from a higher pressure area outside said reservoir through said gas leakage path into said reservoir to provide increased pressure inside said reservoir, and whereby subsequent removal of gas pressure from the exterior of said reservoir will cause the increased pressure in said reservoir to expand said expandable segment into its expanded state and provide said open state for said discharge passage, thus causing the component in said reservoir to be expelled into the rest of the container.

2. The insert of claim 1 wherein: said reservoir has an upper edge defining an open top, which top is adapted to be covered by a sealing member to provide a sealed reservoir.

3. The insert of claim 1 wherein: said reservoir has an upper edge and said valve member includes:

a rotatable arm having first and second ends, and a spigot, said first end being connected to said upper edge of said reservoir, said second end connected to and supporting said spigot said arm and spigot being rotatable about said upper edge from a position exterior of said reservoir to a position where said spigot engages said discharge passage in said closed state.

4. The insert of claim 3 wherein: said reservoir has an upper edge defining an open top, which top is adapted to be covered by a sealing member to provide a sealed reservoir.

5. The insert of claim 4 further comprising:

a support member having a first end integrally connected to said stationary segment of said reservoir and extending into said reservoir to engage and support said spigot in said closed state of said valve.

6. The insert of claim 3 further comprising:

a support member having a first end integrally connected to said stationary segment of said reservoir and extending into said reservoir to engage and support said spigot in said closed state of said valve.

7. An insert adapted to be mounted in a multi-component container to hold one of the components of the container, comprising:

a reservoir and a valve member, said reservoir having a wall and a sealing sheet across the top of said wall said wall having a stationary segment and an expandable segment that includes a plurality of annular fold lines of opposite sense, rotation about said fold lines providing a contracted state and an expanded state, said expandable segment having a discharge passage, said valve member engageable with said discharge passage when said expandable segment is in its contracted state, thus providing a closed state for said discharge passage, said valve member and said discharge passage in said closed state providing a one way gas leakage path into said reservoir, said valve member and said discharge passage disengaging when said expandable segment moves into its expanded state, thus providing an open state for said discharge passage, whereby assembly of said insert containing one of the components and in said closed state into a container permits leakage of gas from a higher pressure area outside said reservoir through said gas leakage path into said reservoir to provide increased pressure inside said reservoir, and whereby subsequent removal of gas pressure from the exterior of said reservoir will cause the increased pressure in said reservoir to expand said expandable segment into its expanded state and provide said open state for said discharge passage, thus causing the component in said reservoir to be expelled into the rest of the container.

8. The insert of claim 7 wherein: said reservoir has an upper edge and said valve member includes:

a rotatable arm having first and second ends, and a spigot, said first end being connected to said upper edge of said reservoir, said second end connected to and supporting said spigot said arm and spigot being rotatable about said upper edge from a position exterior of said reservoir to a position where said spigot engages said discharge passage in said closed state.

9. The insert of claim 8 further comprising:

a support member having a first end integrally connected to said stationary segment of said reservoir and extending into said reservoir to engage and support said spigot in said closed state of said valve.

* * * * *